US006872171B2

(12) United States Patent
Haselrig

(10) Patent No.: US 6,872,171 B2
(45) Date of Patent: Mar. 29, 2005

(54) MARTIAL ARTS TRAINING BAG

(76) Inventor: Donald A. Haselrig, 6123 St. Marie St., Pittsburgh, PA (US) 15205

( * ) Notice: Subject to any disclaimer, the term of this patent is extended or adjusted under 35 U.S.C. 154(b) by 26 days.

(21) Appl. No.: 10/217,136

(22) Filed: Aug. 12, 2002

(65) Prior Publication Data

US 2003/0073548 A1 Apr. 17, 2003

Related U.S. Application Data

(63) Continuation-in-part of application No. 09/520,105, filed on Mar. 7, 2000, now Pat. No. 6,432,027.
(60) Provisional application No. 60/123,386, filed on Mar. 8, 1999.

(51) Int. Cl.[7] ..... A63B 21/02
(52) U.S. Cl. ..... 482/83; 482/90
(58) Field of Search ..... 482/83–90; 473/441–445, 473/498, 422

(56) References Cited

U.S. PATENT DOCUMENTS

| | | | | |
|---|---|---|---|---|
| 2,237,599 | A | * | 4/1941 | Gilman |
| D169,243 | S | * | 4/1953 | Doherty |
| 5,800,319 | A | * | 9/1998 | Choate |
| 5,899,835 | A | * | 5/1999 | Purunda |
| 6,033,348 | A | * | 3/2000 | Warshauer |
| 6,432,027 | B1 | * | 8/2002 | Haselrig |

FOREIGN PATENT DOCUMENTS

GB PCTGB94/01233 * 6/1993

* cited by examiner

*Primary Examiner*—Jerome Donnelly
(74) *Attorney, Agent, or Firm*—Webb Ziesenheim Logsdon Orkin & Hanson, P.C.

(57) ABSTRACT

A martial arts training bag is provided having a substantially cylindrical upper portion and a tapered, e.g., frusto-conical, lower portion. The bag includes a central support and one or more training devices configured to be releasably connected to the central support.

13 Claims, 5 Drawing Sheets

MARTIAL ARTS TRAINING BAG

CROSS-REFERENCE TO RELATED APPLICATIONS

This application is a continuation-in-part of U.S. application Ser. No. 09/520,105, filed Mar. 7, 2000 now U.S. Pat. No. 6,432,027, which claimed the benefits of U.S. application Ser. No. 60/123,386, filed Mar. 8, 1999, both of which applications are herein incorporated by reference in their entirety.

BACKGROUND OF THE INVENTION

1. Field of the Invention

This invention relates generally to exercise equipment and, more particularly, to a punching and kicking bag particularly adapted for use by martial arts practitioners.

2. Description of the Available Technology

Punching bags or "heavy bags" are well known for general fitness training or boxing. Conventional punching bags are generally cylindrical in shape having a canvas cover filled with stuffing material. These bags are generally hung from the ceiling and used for punching or kicking exercises. However, such conventional punching bags are not well adapted for martial arts training. Typically, such conventional bags are machine stuffed and, therefore, are too hard for simulating realistic punching or kicking exercises. Additionally, such cylindrically-shaped bags are not representative of typical human body angles and, therefore, do not allow for realistic punching and kicking exercises. Further, conventional bags are not well adapted for ground fighting techniques, since they are typically hung well above the floor. Also, such conventional bags are not well suited to practice trapping and blocking exercises or simulated weapons attacks. Additionally, conventional bags are not well adapted for practicing the different fighting stances and attack styles found in different martial arts systems.

Attempts have been made to overcome some of the limitations of conventional punching bags. For example, water core bags have been developed which present a more realistic feel when struck. However, such water core bags do not overcome the limitations of poor striking angles and poor trapping and blocking training inherent in conventional bags.

Therefore, it would be advantageous to provide a martial arts training bag having improved kicking and punching angles and also a realistic feel when struck. It would also be advantageous if such a martial arts training bag could be used for different fighting techniques, such as long range, short range, and ground fighting techniques, and also for use by practitioners at different skill levels and with different body types. It would further be advantageous to provide a martial arts training bag which could be used to practice trapping and blocking exercises and simulated weapons attacks.

SUMMARY OF THE INVENTION

A martial arts training bag is provided having an upper portion and a lower portion. The bag can include a support, such as a metal or plastic internal support, surrounded by foam or other elastic material and an outer covering. The upper portion of the bag can include one or more spaced apart and extensible arms, one or more head targets or speed bag assemblies, one or more target spots, a removable high kick device and/or a removable lance device. An annular striking ring can separate the upper portion of the bag from the lower portion. The lower portion can include a tapered, e.g., frusto-conical, region with an extension or sweep post extending downwardly therefrom. A hook, such as a spring hook, can be attached to the top of the bag and can be used to hang the bag in conventional manner. The head targets, speed bag assemblies, and/or the arms can be removably attached to the bag. In one embodiment, the head targets, speed bag assemblies, and/or the arms can be removably connectable with the internal support.

In another embodiment, the martial arts training bag of the invention can include one or more extensible arms, one or more head targets or speed bag attachments, and/or one or more target spots. In this embodiment, the bag can be carried on a base. The base can be hollow and can be filled with ballast material, such as water or sand.

A complete understanding of the invention will be obtained from the following description when taken in connection with the accompanying drawings, wherein like reference characters identify like parts throughout.

DESCRIPTION OF THE PREFERRED EMBODIMENTS

Figure 3:
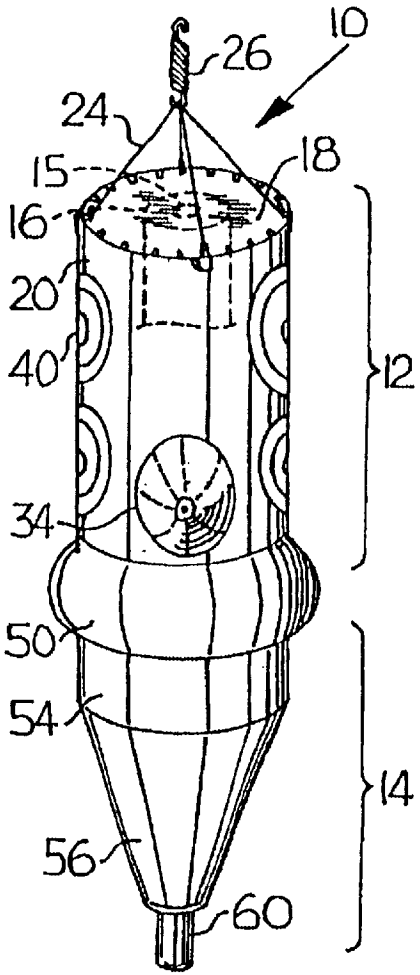
FIG. 3 is a side, elevational view of the bag shown in FIG. 2 rotated 180° to the left.

For purposes of the description hereinafter, the terms "right", "left", "above", "below" and similar spacial terms shall relate to the invention as it is oriented in the drawing figures. However, it is to be understood that the invention can assume various alternative orientations and, therefore, such terms should not be considered limiting except where expressly specified to the contrary. It is also to be understood that the specific devices illustrated in the attached drawings, and described in the following specification, are simply exemplary embodiments of the invention. Hence, specific dimensions and other physical characteristics related to the embodiments disclosed herein are not to be considered as limiting unless specifically set forth in the claims. Further, all numbers expressing dimensions, physical characteristics, and the like used in the specification and claims are to be understood as being modified in all instances by the term "about". Accordingly, unless indicated to the contrary, the numerical values set forth in the following specification and claims are approximations that can vary depending upon the desired properties sought to be obtained by the present invention. At the very least, and not as an attempt to limit the application of the doctrine of equivalents to the scope of the claims, each numerical value should at least be construed in light of the number of reported significant digits and by applying ordinary rounding techniques. Moreover, all ranges disclosed herein are to be understood to encompass any and all subranges subsumed therein. For example, a stated range of "1 to 10" should be considered to include any and all subranges between (and inclusive of) the minimum value of 1 and the maximum value of 10; that is, all subranges beginning with a minimum value of 1 or more and ending with a maximum value of 10 or less, e.g., 5.5 to 10. Additionally, any reference indicated as "incorporated herein" is to be understood to be incorporated in its entirety.

Figure 2:
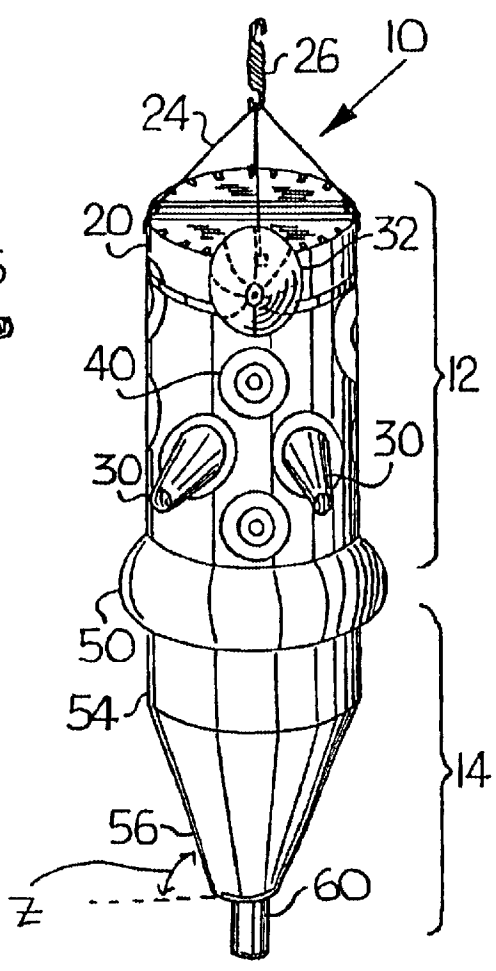
FIG. 2 is a side, elevational view of the bag shown in FIG. 1 rotated 90° to the left.
Figure 1:
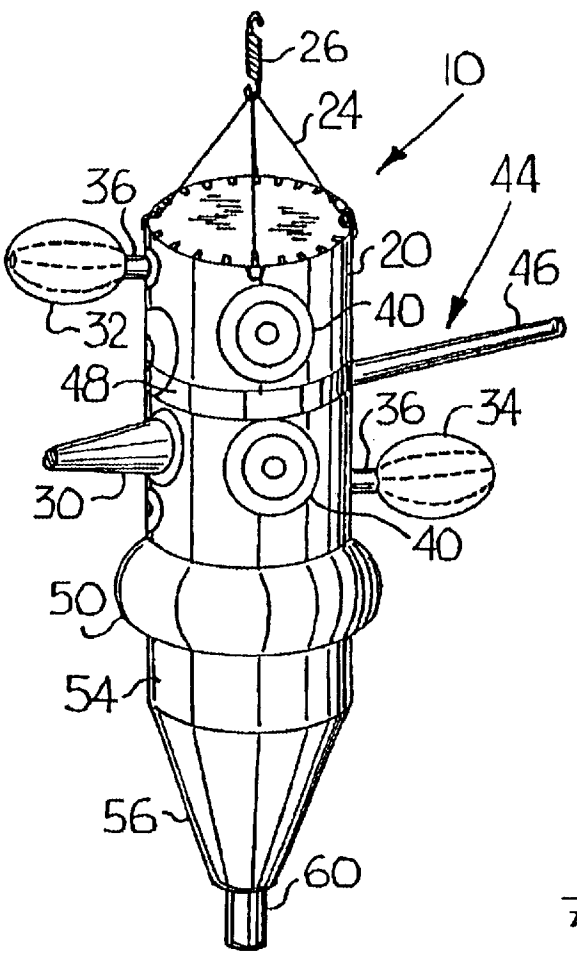
FIG. 1 is a side, elevational view of a first embodiment of a martial arts training bag of the invention.

A first embodiment of a martial arts training bag of the invention is generally designated 10 in FIGS. 1–3. The bag 10 generally includes a first or upper portion 12 and a second or lower portion 14. As shown by dashed lines in FIG. 3, the bag 10 can have a central, internal, rigid support 15, such as but not limited to a metal, plastic, or wooden support. In one embodiment, the support 15 can be a piece of hollow PVC pipe or a tubular metal support. In one embodiment, the support 15 can be surrounded by a core 16 of dry, hard material, such as but not limited to dried bean pebbles or similar material, which can be in turn surrounded by a compressible material, such as conventional stuffing material or a foam liner 18. In one embodiment, the foam liner 18 can be about 1 inch (2.54 cm) to about 2 feet (61 cm) thick, such as about 2 inches (5 cm) to about 1 foot (30 cm) thick, for example about 2.5 inches (6.4 cm) thick. The core 16 can, in one embodiment, be fluid filled, such as water filled, or can be made of conventional stuffing material. The liner 18 can be further surrounded by a substantially water-resistant and tear-resistant cover 20, such as leather, canvas, or Naugahyde, or any such conventional material. One or more connectors, such as straps or chains 24, can be attached to the top of the bag 10 in conventional manner, such as by stitching, and can also be attached to a mounting device 26, such as a conventional spring hook device, so that the bag 10 can be hung in conventional manner for use.

The upper portion 12 of the bag 10 can be substantially cylindrical and can include at least one, such as a pair, of spaced apart arms 30 extending outwardly from the side of the bag 10. The arms 30 can be of uniform diameter or can be tapered or contoured to simulate the shape of a human arm. In one embodiment, the arm 30 can have a rounded outer end (simulating a fist), a tapered middle section, and a thicker inner end to simulate the shape of a human arm. The contoured arm 30 can surround a deformable member, such as a spring. The arms 30 also can be telescoping or extensible such that the length of the arms 30 can be adjusted. The arms 30 can be of any suitable material, such as wood, plastic, metal, PVC, etc., and can be surrounded with a removable, padded covering.

The bag 10 also includes at least one head target, such as at least one first or upper head target 32 and at least one second or lower head target 34 extending from the side of the bag 10. In one embodiment, the head targets 32, 34 can be substantially oval-shaped and can be attached to the bag 10 in conventional manner, such as by a post 36. The inner end of each post 36, as well as the inner ends of the arms 30, can be attached to the central support 15 in any conventional manner to provide structural support for the head targets 32, 34 and arms 30. The head targets 32, 34 can be formed from contoured heavy density foam material covered with a suitable material, such as leather, canvas, or Naugahyde. Alternatively, the head targets 32, 34 can be inflatable, e.g., made of inflatable plastic, or can be made of other suitable stuffing material. The head targets 32, 34 can be approximately the size of a typical human head. A plurality of optional target spots 40 can be located on the bag. The target spots 40 can correspond in location to designated target areas on the human body, such as the kidneys or various pressure points. In another embodiment described below, the head targets 32, 34 can be in the form of speed bag assemblies utilizing a conventional boxing-type speed bag.

A lance device 44 can also be attached, e.g., removably attached, to the bag 10. In one embodiment, the lance device 44 includes an elongated lance 46 formed of conventional material, such as PVC piping, wood, plastic, or metal and can be covered by a padded sleeve. The lance 46 can be carried on an attachment device, such as a belt or strap 48, which can be placed around the bag 10 and held in place in a conventional manner, such as by a conventional locking mechanism, such as a buckle. The lance 46 can be telescoping or can be of a fixed length.

In one embodiment, a curved, annular striking ring 50 can extend outwardly around the bag 10 near the bottom of the upper portion 12 and can generally separate the bag 10 into the upper portion 12 and lower portion 14. The striking ring 50 can have a substantially semi-circular cross section and can have a core of suitable material, e.g., conventional stuffing materials such as shredded cloth, sawdust, etc., covered by a foam pad or liner and can extend transversely (i.e., substantially perpendicularly to a longitudinal axis of the bag 10) or horizontally around the bag 10 under the cover 20. The striking ring 50 can be permanently attached as a permanent part of the bag 10 or, as discussed below with respect to FIG. 4, can be removable. Alternatively, the striking ring 50 can be fluid filled, such as filled with liquid (such as water) or gas (such as air).

In one embodiment, the lower portion 14 of the bag 10 includes a substantially cylindrical region 54 below the striking ring 50. A tapered region 56 extends downwardly from the cylindrical region 54 and can be substantially frusto-conical in shape.

A sweep post 60 can extend from the bottom of the tapered region 56. The sweep post 60 can be made of wood and can be attached to the bottom of the bag 10 in any conventional manner, such as by stitching. The sweep post 60 can also be formed by the bottom portion of the support 15 extending beyond the bottom of the bag 10 and can be surrounded by a padded sleeve. Still further, the sweep post 60 can be formed from a leather or other such durable cover material surrounding or containing stuffing material, such as but not limited to dried bean pebbles or other such stuffing materials, such that the sweep post 60 can be kicked or contacted, e.g., by a user's foot, without injuring the user's foot.

Figure 4:
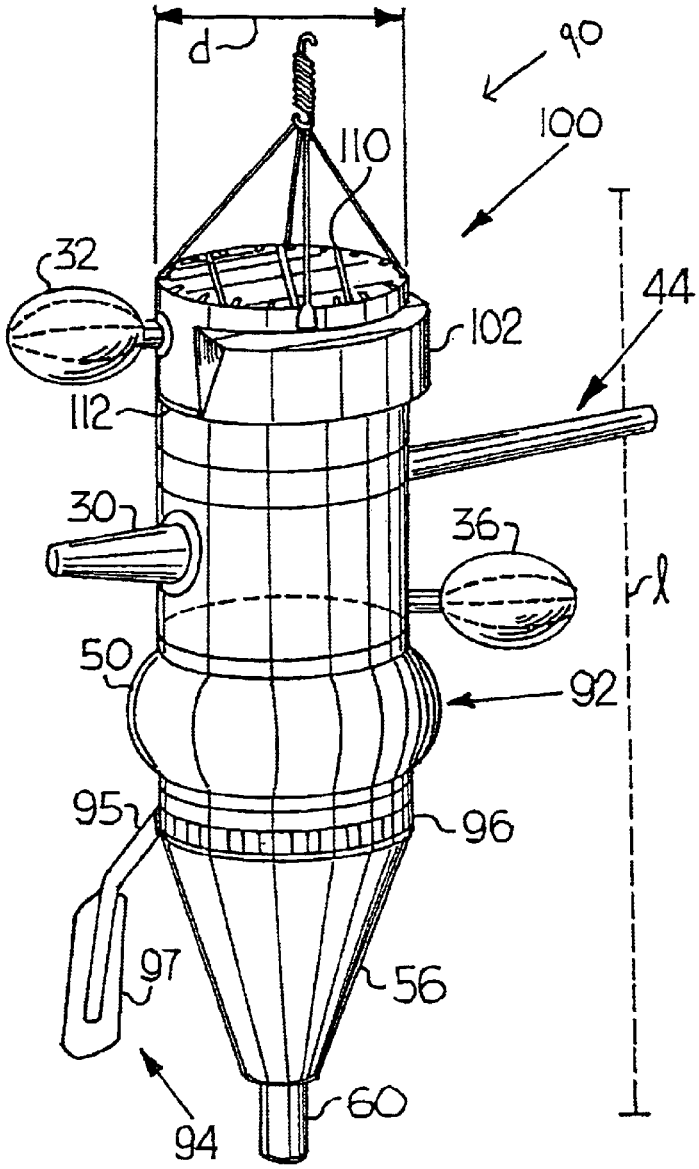
FIG. 4 is a side, elevational view of a further embodiment of the invention similar to that of FIG. 1, but including a leg parry device.

A modified bag 90 of the invention is shown in FIG. 4. The bag 90 is similar to the bag 10 shown in FIG. 1 and described above, but includes a removable striking ring 92. For example, the striking ring 92 can be formed by a core of stuffing material, such as but not limited to bean pebbles, cloth, sawdust, etc., surrounded by a covering of water-resistant and/or tear-resistant material, such as leather, canvas, or Naugahyde. The striking ring 92 can be removably held in place by any conventional means, such as by a conventional strap or belt which may be buckled around the bag 90. Alternatively, the striking ring 92 can be fluid filled, e.g., air or water filled.

A leg parry device 94 can be removably mounted on the bag 90. In one embodiment, the leg parry device 94 comprises a support 95 attached to the bag 90, for example, by a strap or belt 96. Alternatively, the support 95 can be permanently affixed to the bag 90, such as by being attached to the central support 15. In one embodiment, the support 95 comprises a bent, lower portion surrounded by a sleeve of padded material 97. The leg parry device 94 can also be used with the bag 10.

Figure 5:
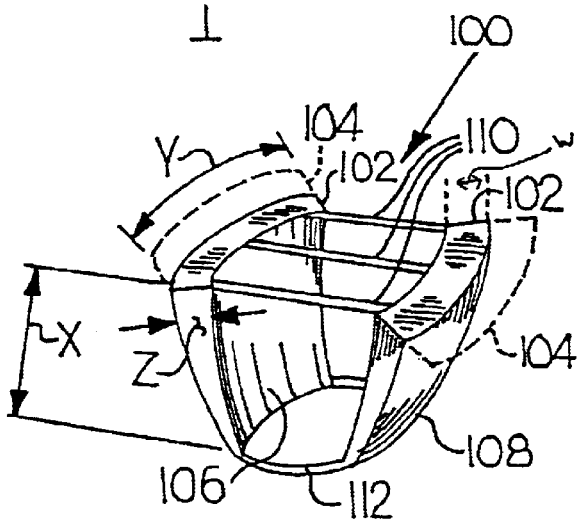
FIG. 5 is a side, elevational view of a high kick device of the invention.

Additionally, as shown in FIGS. 5, 4, and 2, the bag 10, 90 can include a high kick device 100 which can be permanently or removably mounted on the bag 10, 90. As shown in FIG. 5, in one embodiment a removable high kick device 100 includes a plurality of high kick pads 102. The high kick pads 102 can be tapered and can be filled with conventional padding or stuffing material as discussed above covered by a wear- and/or tear-resistant covering. Alternatively, the high kick pads 102 can be formed as hollow pouches having an open top covered by a top flap 104 (shown by dashed lines in FIG. 5) so that a practitioner can fill the high kick pads 102 with any desired material, such as but not limited to dried bean pebbles. The top flap 104 can be fastenable to the pad 102 in any conventional manner, such as by buckles or Velcro fasteners. In one embodiment, the high kick pads 102 are tapered, i.e., have a wider top and narrower bottom with an inner surface 106 configured to rest against the bag 10, 90 and an outer surface 108 configured to present a tapered striking surface to the practitioner. The high kick pads 102 can be contoured to fit snugly against the bag 10, 90. The high kick pads 102 can be connected by one or more adjustable connecting straps 110 and one or more adjustable holding straps 112. As shown in FIGS. 2 and 4, the high kick device 100 can be slipped over the top of the bag 10, 90 and held in place by tightening the holding straps 112. In one non-limiting embodiment shown in FIG. 5, the high kick pad 102 can have a width W (at the top or wider part of the pad) of about 3 inches to about 4 inches (7.6 cm to 10 cm), a length Y of about 10 inches to about 14 inches (25 cm to 36 cm), and a height X of about 5 inches to about 10 inches (13 cm to 25 cm).

Although not to be considered as limiting, as shown in FIG. 4, one embodiment of the bag 90 (or bag 10) has a length 1 of about 64 inches to about 69 inches (163 cm to 175 cm) and a diameter d of about 16 inches to about 20 inches (41 cm to 51 cm). The first portion 12 has a length of about 26 inches to about 34 inches (66 cm to 86 cm) and the second portion 14 has a length of about 20 inches to about 30 inches (51 cm to 76 cm), with the cylindrical region 54 having a length of about 4 inches to about 10 inches (10 cm to 25 cm) and the tapered region 56 having a length of about 16 inches to about 18 inches (41 cm to 46 cm). The tapered region 56 can have a tapered angle Z of about 70°. The sweep post 60 has a length of about 10 inches to about 12 inches (25 cm to 30 cm). The striking ring 92 (or striking ring 50) has a length of about 4 inches (10 cm). The lance 46 has a length of about 3 feet to about 5 feet (91 cm to 152 cm) and each arm 30 has a length of about 8 inches to about 20 inches (20 cm to 51 cm) from the bag 10. Each head target assembly 32, 34 has a length of about 36 inches (91 cm) from the bag 10.

Figure 6:
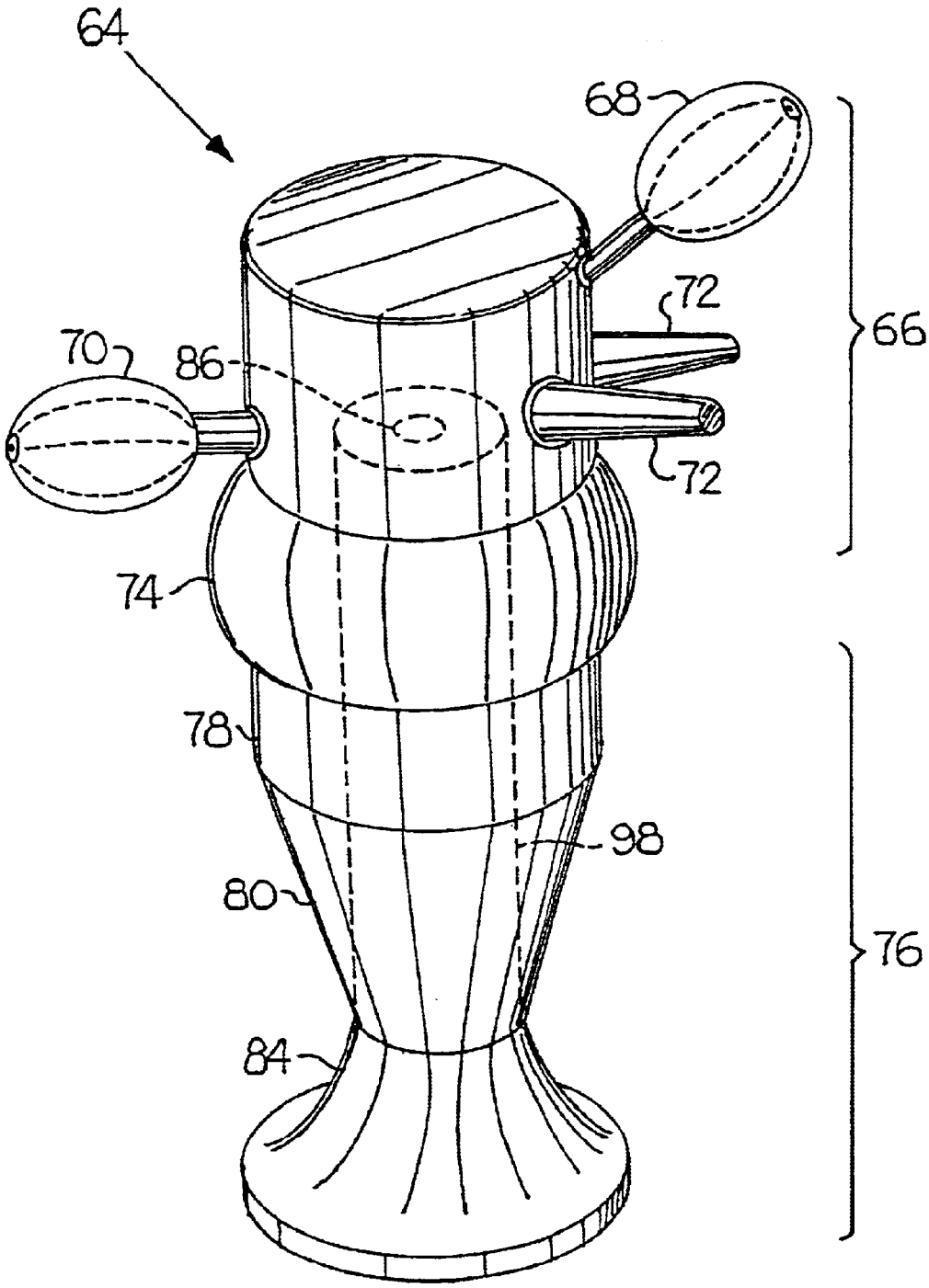
FIG. 6 is a side, elevational view of a second embodiment of a martial arts training bag of the invention.

A second embodiment of the training bag of the invention is generally designated 64 in FIG. 6. The training bag 64 can be shorter than the training bag 10 shown in FIGS. 1–3 and is specifically configured to be placed on a floor rather than being hung like the first training bag 10. The training bag 64 includes an upper portion 66 having at least one upper head target 68 and at least one lower head target 70, at least one, such as a pair, of spaced-apart optionally extensible arms 72, and an annular striking ring 74. The bag 64 can also include a removable lance device (not shown), a high kick device (not shown) and target spots (not shown) similar to the same elements discussed above with respect to the earlier embodiments of the bag 10 or bag 90.

The bag 64 also includes a lower portion 76 having a substantially cylindrical region 78 and a tapered region 80. However, in this embodiment, the tapered region 80 is carried on a pedestal or base 84. The base 84 can be made of durable material, such as hard plastic, but can also be made of other suitable material, such as metal. In one embodiment, the base 84 is hollow and has an opening coverable with a sealing cap 86. Ballast material, such as water or sand, can be placed in the base 84 through the opening to help prevent the bag 64 from toppling over when struck. The bag 64 can have a hollow passage 98 which slips over the upper part of the base 84 to hold the bag 64 upright. The bag 64 can be held in place on the base 84 in any conventional manner, such as by any conventional fastening devices to prevent rotation of the bag 64 on the base 84 when struck.

Figure 7:
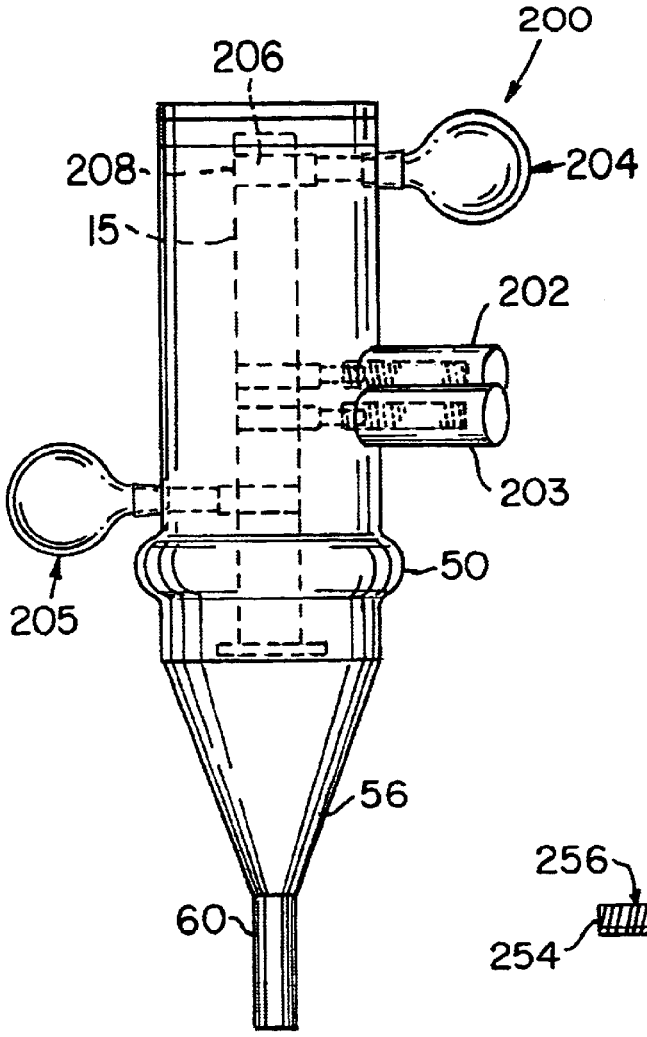
FIG. 7 is a side, cut-away view of another martial arts training bag of the invention.
Figure 8:
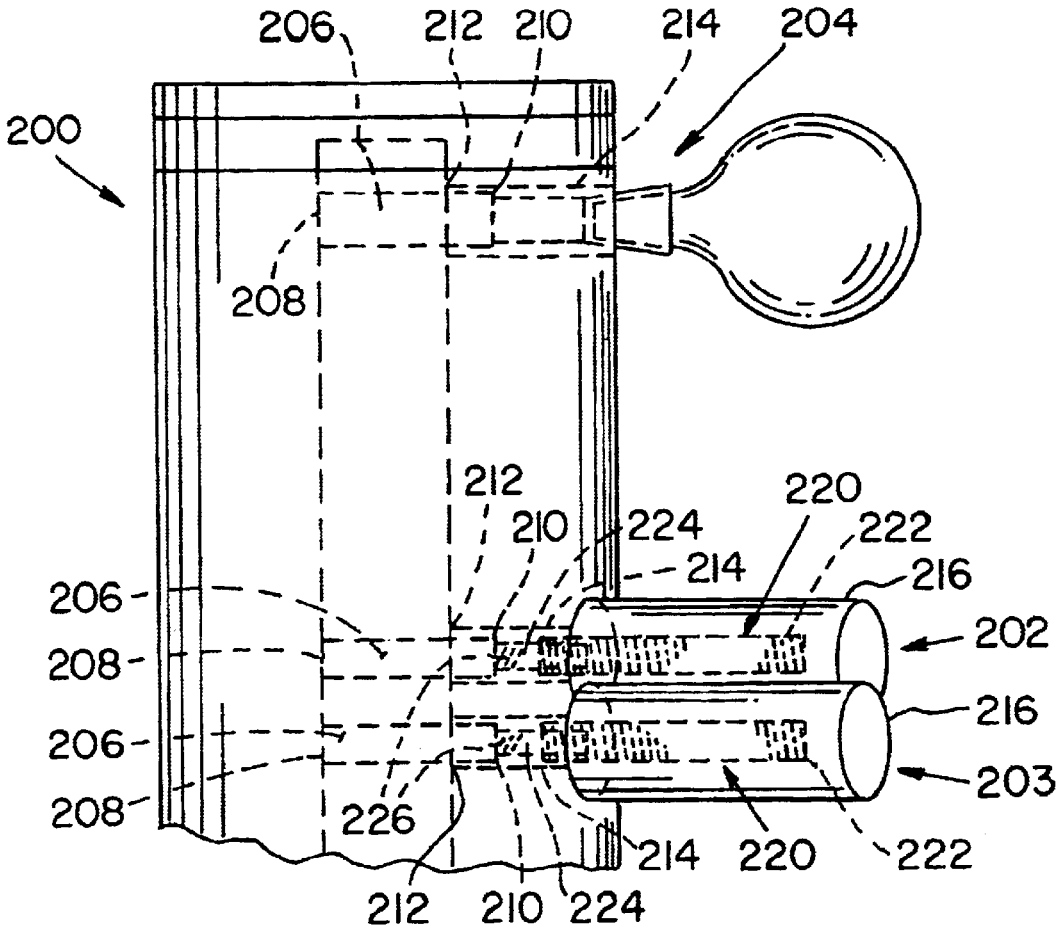
FIG. 8 is a side, cut-away view of a speed bag attachment and a pair of arms attached to a bag by an exemplary attachment assembly of the invention.

A further embodiment 200 of a martial arts training bag of the invention is shown in FIGS. 7 and 8. Looking at FIG. 7, the martial arts training bag 200 is similar to the training bag 10 shown in FIGS. 1–3. However, in this embodiment, the training bag 200 includes at least one removable training device, such as at least one arm, e.g., arms 202 and 203, and/or at least one removable head target, such as in the form of an upper speed bag assembly 204 and a lower speed bag assembly 205 removably carried on the bag 200, e.g., removably connected to the support 15. In this embodiment, the support 15 can be a substantially cylindrical, hollow metal pipe. An exemplary system for removably attaching the arms 202, 203 and/or the speed bag assemblies 204, 205 will now be described. As shown particularly in FIGS. 7 and 8, the support 15 can include one or more attachment elements or devices 206 configured to removably engage the arms 202, 203 and/or speed bag assemblies 204, 205 of the invention. In one embodiment, the attachment devices 206 can be substantially cylindrical, hollow metal tubes or pipes having internal threads. In this embodiment and as particularly shown in FIG. 8, a first end 208 of the attachment device 206 is connected to the support 15, such as the first end 208 being welded to the inner wall of the hollow support 15. A second end 210 of the attachment device 206 can extend through a hole 212 in the support 15 and into a channel or passage 214 formed in the bag 200. The attachment device 206 at or near the second end 210 can also be welded to the support 15. For example, in one embodiment, the attachment device 206 can be welded to the support 15 around the hole 212 through which the attachment device 206 extends.

In the illustrated embodiment, the arms 202, 203 can include a padded sleeve 216 surrounding an attachment member or assembly 220, with the attachment assembly 220 configured to extend through the passage 214 and releasably engage the attachment device 206. The arms 202, 203 can be of any desired shape, such as cylindrical. In one embodiment, the arms 202, 203 can have a rounded outer end (simulating a human fist), a tapered middle portion, and a thicker inner portion to simulate the shape of a human arm. In one embodiment, the attachment assembly 220 includes a deformable member 222, such as a metal spring, which extends into and/or is surrounded by the sleeve 216. A connecting device 224, such as a rigid shaft, is attached to or extends from the spring 222. The connecting device 224 is configured to releasably engage the attachment device 206 such that the arms 202, 203 are removable from the bag 200. In one embodiment, the connecting device 224 is a metal rod or tube having external threads 226. The external threads 226 of the connecting device 224 are configured to engage the internal threads (not shown) of the attachment device 206 such that the connecting device 224 and, hence, the arms 202, 203 can be screwed onto or into the attachment device 206 to secure the arms 202, 203 to the bag 200 or unscrewed to remove the arms 202, 203.

Figure 9:
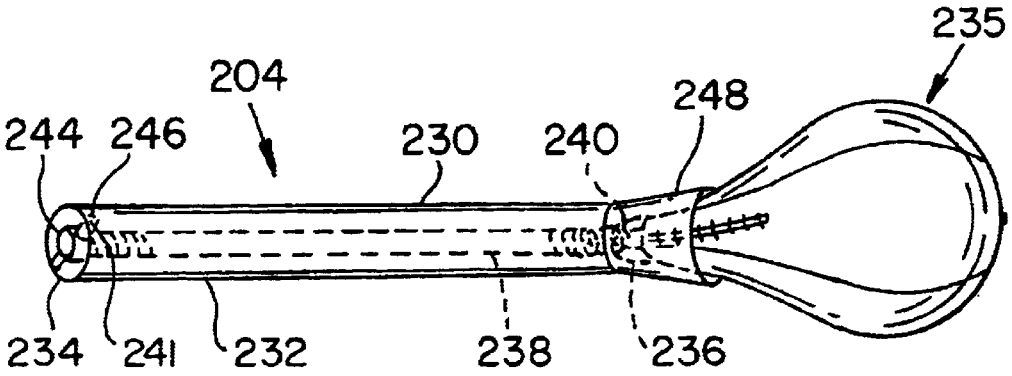
FIG. 9 is a side, cut-away view of a speed bag assembly of the invention.

An exemplary head target in the form of a speed bag assembly 204 is shown in FIG. 9. The speed bag assembly 204 includes a shaft 230, such as a hollow, cylindrical pipe. The shaft 230 has external threads 232 on or near a first end 234, with the threads 232 configured to engage the internal threads of the attachment device 206. A conventional speed bag 235 is held at one end of the shaft 230. In the illustrated embodiment, the speed bag 235 includes a loop 236 which extends into the shaft 230. A spring 238 having a hook 240 at one end engages the loop 236 of the speed bag 235. The other end 241 of the spring 238 is fixedly mounted in the shaft 230, such as by a hook 242 on the end 241 of the spring 238 which engages a bolt or pin 246 installed in the shaft 230. To connect the speed bag assembly 204 to the bag 200, the threaded end 234 of the shaft 230 can be inserted through one of the passages 214 in the bag 200 and into one of the attachment devices 206. The speed bag assembly 204 can then be rotated to threadably engage the external threads 232 of the shaft 230 with the internal threads of the attachment device 206 to hold the speed bag assembly 204 in place and unscrewed when it is desired to remove the speed bag assembly 204. In the illustrated embodiment, the speed bag assembly 204 includes an outwardly flared portion 248 at the outer end of the shaft 230. The speed bag 235 extends into the flared outer portion 248 to help stabilize the bag 235 when struck.

Figure 10:
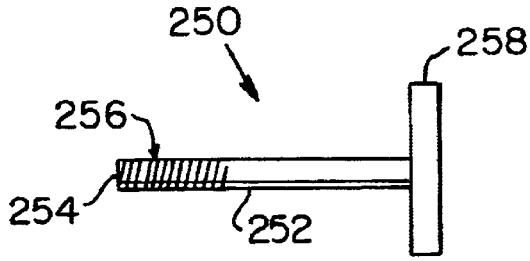
FIG. 10 is a side view (not to scale) of a striking pad attachment of the invention.

A striking pad attachment 250 of the invention is shown in FIG. 10. The striking pad attachment 250 can include a shaft 252 with one end 254 configured to releasably engage the attachment device 206 of the bag 200. For example, in one embodiment, the shaft 252 has external threads 256 configured to engage internal threads on an attachment device 206. A striking pad 258 is located on one end of the shaft 252. The striking pad 258 can be a conventional padded target configured to be struck by a user. In one embodiment, the striking pad 258 can be a round, padded target having a foam pad, a wood and/or metal base, and surrounded by a durable covering (such as those described above for the bag).

Figure 11:
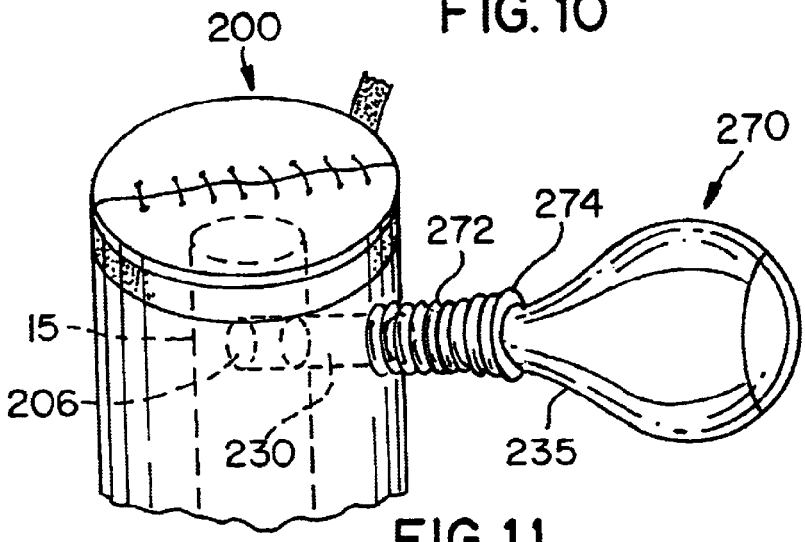
FIG. 11 is a side, cut-away view (not to scale) of an alternative speed bag assembly of the invention.

FIG. 11 illustrates an alternative embodiment 270 of the speed bag assembly 204 shown in FIG. 9. In the alternative embodiment 270, the flared portion 248 of the shaft is replaced by a spring 272 which, as shown in FIG. 11, can include a wider outer end 274 into which the speed bag 235 can extend.

The bag 200 can also have any one or more of the features of the bags 10, 90, and 64 shown in FIGS. 1–6, such as but not limited to a lance device, a striking ring, a sweep post, a leg parry device, a high kick device, target spots, etc.

In the embodiment shown in FIGS. 7–9, one or more of the arms 202, 203, and/or the striking pad attachment(s) 250, and/or the speed bag assemblies 204, 205 (or speed bag assembly 270) can be removably connected to the bag 200 for ease of shipping and storage. For example, when the bag 200 is to be used, one or more of the arms 202, 203, and/or speed bag assemblies 204, 205 (or speed bag assembly 270), and/or the striking pad attachment(s) 250 can be engaged with the support 15 and the bag 200 used in similar manner as described above with respect to the bags shown in FIGS. 1–6. If the bag 200 is to be stored or shipped, the arms 202, 203 and/or speed bag assemblies 204, 205, 270, and/or striking pad attachment(s) 250 can be removed and packaged separately from the bag 200 itself to decrease the volume required to ship the bag 200.

An exemplary method of operation of the martial arts training bags 10, 90, 64, and 200 of the invention will now be described.

There are many different styles of martial arts, for example, long range arts, such as Korean Tae Kwan Do; long range to intermediate range, such as kicking and punching arts; close range, such as conventional boxing or street fighting techniques; and styles which encompass all of these ranges, such as Indonesian Pentjak Silat. The present invention can be used by a practitioner of any of these styles to practice techniques ranging from long range punching and kicking to close range and ground fighting techniques. Further, the present invention is useful not only for highly skilled practitioners but also is well adapted for novice training. The invention is also easily utilized by students of different body types.

Turning first to the training bags 10, 90, and 200 in FIGS. 1–4 and 7–9, the present invention provides many advantages over known punching and striking bags and is particularly well adapted to the martial arts practitioner. For example, the bags 10, 90, 200 have angles and contours that are more realistic of a human target and, therefore, particularly well adapted for martial arts punching and kicking exercises. The bags 10, 90, 200 are useful not only for stand-up techniques but also for ground fighting.

For example, the arms 30, 202, 203 can be used for trapping or elbow strike techniques and can be extensible to simulate intermediate and close in strikes. The upper and lower head targets 32 and 34 (or speed bag assemblies 204, 205, or 270) permit the practice of both high kicks and low kicks simulating strikes to the head of an opponent. The high kick device 100 can be used to practice side kicks to the head of an opponent. The target spots 40 can be used to develop accuracy and strength in striking an opponent's body. The removable lance device 44 is particularly well adapted to practice ducking and weaving moves simulating a sword or lance attack by an opponent. The annular striking ring 50 is useful for practicing knee strikes and uppercuts and has contours which more realistically simulate striking a human body than is possible with a conventional punching bag. The tapered region 56 of the lower portion 14 is useful for practicing low kicks and instep kicks. The sweep post 60 is also well adapted for practicing instep kicks and for instep conditioning, as well as for practicing sweeping kicks to sweep an opponent's legs from under him. The leg parry device 94 is useful for low leg parries and stop kicks. A striking pad attachment 250 can be used to practice striking or punching.

The training bag 64 shown in FIG. 4 can be used generally as described above, with the exception that no sweep post 60 is provided. This bag 64 can be particularly useful in ground fighting technique practice or in areas where a training bag is not able to be hung from the ceiling. Additionally, the training bag 64 can be easily transported by opening the cap 86 and removing the ballast from the base 84 to lighten the overall weight of the bag 64 for easier transport.

The training bags 10, 64, 90, 200 discussed above can be provided as a kit with one or more of the bags 10, 64, 90, 200 and one or more selected training devices, such as the lance device, striking ring, leg parry device, arms, speed bag assemblies, striking pad attachments, head targets, and/or high kick device, included in the kit as desired by a purchaser.

Thus, the present invention provides significantly improved training bags 10, 64, 90, 200 particularly well adapted for the martial arts practitioner. The kicking and striking targets, as well as the angles and contours of the bags 10, 64, 90, 200 itself, provide improved striking surfaces over conventional bags.

It will be readily appreciated by those skilled in the art that various modifications may be made to the invention without departing from the concepts disclosed in the foregoing description. For example, while in the embodiments described above the training device was removably connected to the bag using internally and externally threaded members, it is to be understood that any conventional attachment devices could be used, such as but not limited to bayonet mounts, screws, bolts, and the like. Accordingly, the particular embodiments described in detail herein are illustrative only and are not limiting to the scope of the invention, which is to be given the full breadth of the appended claims and any and all equivalents thereof.

What is claimed is:

1. A martial arts training bag, comprising:

a substantially cylindrical first portion;

a tapered second portion depending from the first portion; and at least one training device removably engagable with the first portion, wherein the at least one training device includes:

at least one first head target extending from the first portion;

at least one second head target extending from the first portion and spaced from the first head target; and at least one arm extending from the first portion between the first and second head targets.

2. A martial arts training bag, comprising:

a substantially cylindrical first portion;

a tapered second portion depending from the first portion;

a rigid support having at least one attachment element;

at least one passage extending into the bag to the attachment element; and at least one training device having an attachment member, wherein the attachment member of the training device is configured to extend into the passage to releasably engage the attachment element of the support.

3. The training bag of claim 2, wherein the support is a metal tube.

4. The training bag of claim 2, wherein the attachment element includes a rigid device having threads.

5. The training bag of claim 2, wherein the attachment member includes a shaft having threads.

6. The training bag of claim 5, wherein the training device is selected from an arms or a speed bag assembly, or a striking pad attachment.

7. The training bag of claim 6, wherein the arm includes a padded sleeve surrounding a deformable member, with the deformable member connected to a shaft having threads.

8. A martial arts training bag, comprising:

a substantially cylindrical first portion;

a tapered second portion depending from the first portion;

a rigid internal support;

at least one attachment element carried on the support, the attachment element comprising a rigid device having internal threads;

at least one passage extending from an outer surface of the bag to the attachment element; and at least one training device removably carried on the bag, the training device including an attachment member having external threads configured to engage the internal threads of the attachment element when the attachment member is inserted into the passage.

9. A martial arts training bag kit, comprising:

a bag having an outer surface, a substantially cylindrical first portion, and a tapered second portion depending from the first portion;

a rigid internal support having at least one attachment element;

at least one passage extending through the bag from the outer surface to the attachment element; and at least one training device having an attachment member, the attachment member configured to extend into the passage to releasably engage the attachment element.

10. The training bag kit of claim 9, wherein the at least one training device includes at least one of an arm, a striking pad attachment, and a speed bag assembly.

11. The training bag of claim 2, further including a removable striking ring configured to extend outwardly around the bag.

12. The training bag of claim 8, further including a removable striking ring configured to extend outwardly around the bag.

13. The training bag kit of claim 9, further including a removable striking ring configured to extend outwardly around the bag.

* * * * *

UNITED STATES PATENT AND TRADEMARK OFFICE

CERTIFICATE OF CORRECTION

PATENT NO. : 6,872,171 B2
DATED : March 29, 2005
INVENTOR(S) : Haselrig

It is certified that error appears in the above-identified patent and that said Letters Patent is hereby corrected as shown below:

Title page,
Item [76], Inventor, "Pittsburgh, PA (US) 15205" should read -- Pittsburgh, PA (US) 15206 --.
Item [*] Notice, delete the current notice and insert in its place:
-- The term of this patent shall not extend beyond the expiration date of Patent No. 6,432,027. --.

Column 10,
Line 8, "from an arms" should read -- from an arm --.

Signed and Sealed this

Sixteenth Day of August, 2005

JON W. DUDAS
*Director of the United States Patent and Trademark Office*